US007479893B2

(12) United States Patent
Weston et al.

(10) Patent No.: US 7,479,893 B2
(45) Date of Patent: Jan. 20, 2009

(54) METHOD AND APPARATUS OF GENERATING A VOICE SIREN IN A SECURITY SYSTEM

(75) Inventors: Lance Weston, East Northport, NY (US); David Mole, Medford, NY (US); Richard H. Hinkson, Plainview, NY (US)

(73) Assignee: Honeywell International Inc., Morristown, NJ (US)

( * ) Notice: Subject to any disclaimer, the term of this patent is extended or adjusted under 35 U.S.C. 154(b) by 288 days.

(21) Appl. No.: 11/322,107

(22) Filed: Dec. 29, 2005

(65) Prior Publication Data

US 2008/0048852 A1 Feb. 28, 2008

(51) Int. Cl.
*G08B 17/10* (2006.01)

(52) U.S. Cl. ..... 340/632; 340/539.16; 340/7.52

(58) Field of Classification Search ..... 340/632, 340/539.16, 539.17, 539.18, 539.11, 506, 340/7.51–7.53
See application file for complete search history.

(56) References Cited

U.S. PATENT DOCUMENTS 5,572,201 A 11/1996 Graham et al.
5,577,104 A 11/1996 Knuth et al.
6,552,647 B1 * 4/2003 Thiessen et al. ..... 340/604
6,661,340 B1 * 12/2003 Saylor et al. ..... 340/7.52
7,103,152 B2 * 9/2006 Naidoo et al. ..... 379/37
7,262,690 B2 * 8/2007 Heaton et al. ..... 340/531
2001/0043144 A1 11/2001 Morris
2004/0201475 A1 10/2004 Menard et al.
2004/0217847 A1 11/2004 Fries et al.

* cited by examiner

*Primary Examiner*—John A Tweel, Jr.
(74) *Attorney, Agent, or Firm*—Scully, Scott, Murphy & Presser, P.C.

(57) ABSTRACT

A security device including a control panel for transmitting a pre-defined cadence pattern to a siren device. The siren device takes the pre-defined cadence pattern as an input and outputs an audible voice message that corresponds to the pre-defined cadence pattern. The siren device is capable of recognizing the pre-defined cadence pattern that indicates a security system armed or disarmed command from a user interface device as well as a detected alarm signal of fire, burglary and carbon monoxide from a corresponding smoke, motion and carbon monoxide detector. These signals are transmitted from either the sensors or user interface means to the control panel and then, in turn, to the siren device.

2 Claims, 5 Drawing Sheets

METHOD AND APPARATUS OF GENERATING A VOICE SIREN IN A SECURITY SYSTEM

FIELD OF THE INVENTION

The invention relates generally to a security system for protecting life and property. More specifically, the invention relates to audible security systems located at a residence or business that is capable of generating an audible notification of a security event.

BACKGROUND OF THE INVENTION

Security systems, such as for homes and businesses, have become commonplace as people seek to protect themselves and their property. A security system includes any life, safety and property protection system. The security system typically includes a central control panel that communicates with a number of sensors via a wired or wireless path.

When any one of the sensors detects an event, the sensors transmit a signal to the central control panel. The central control panel, in turn, generates an alarm signal within the home or business and also sends a signal via a network to a central monitoring station.

Typically, the local alarm signal within the home or business is comprised of a standard cadence algorithm. Each particular cadence algorithm defines a particular alarm event.

A homeowner can determine what type of alarm event occurred based upon the type of cadence algorithm. Alternatively, the central control panel outputs that standard cadence algorithm to a voice siren that can emit an audible voice signal indicating the type of event. Currently the voice siren drivers only recognize a certain limited number of cadence algorithms or patterns.

However, there is a need for the voice siren driver and voice siren to be able to recognize and output a broader range of cadence patterns.

BRIEF SUMMARY OF THE INVENTION

Therefore, it is an object of the present invention to provide a security device located at a home or business that is capable of recognizing a broad range of cadence patterns or algorithms and emitting a voice signal that corresponds to the cadence pattern in response to receiving the cadence algorithm as a result of a detected security event.

A security device comprising a control panel that transmits a predetermined signal pattern via a wireless transceiver, and a voice siren device activated by said control panel to receive the predetermined signal patterns and convert the predetermined signal pattern into an audible voice message is provided. The predetermined signal pattern corresponds to one of a plurality of detected events which is detected by a detection means. One of the plurality of detected events is the detection of carbon monoxide.

The siren device can detect a cadence pattern that corresponds to all of the following events: arm, disarm, fire, burglary and carbon monoxide and output a pre-stored message that corresponds to one or more of the detected events.

Also disclosed is a voice siren device comprising a receiving means, memory section, control section and a speaker means. The receiving means receives at least one predetermined signal pattern from a security system control panel via a wireless transceiver. The memory section stores at least one cadence tone pattern and at least one pre-selected message that corresponds to the at least one cadence tone pattern. The control section compares the received at least one predetermined signal pattern with the stored at least one cadence tone pattern, and when a match is found, the control section selects the at least one pre-selected message that corresponds to the match for playback. The speaker means plays the at least one pre-selected message. The at least one predetermined signal pattern corresponds to one of a plurality of detected events that has been detected by said control panel and said detection means, said plurality of detected events includes at least a detection of carbon monoxide. Additionally, the at least one cadence tone pattern includes a pattern that corresponds to carbon monoxide.

The siren device further comprises a recording means for recording the at least one pre-selected message, and means for assigning said at least one pre-selected message to one of the at least one cadence tone pattern.

A corresponding method for generating a voice siren or tone message is also provided herein.

BRIEF DESCRIPTION OF THE DRAWINGS

These and other features, benefits, and advantages of the present invention will become apparent by reference to the following text figures, with like reference numbers referring to like structures across the views, wherein.

DETAILED DESCRIPTION OF THE INVENTION

Figure 1:
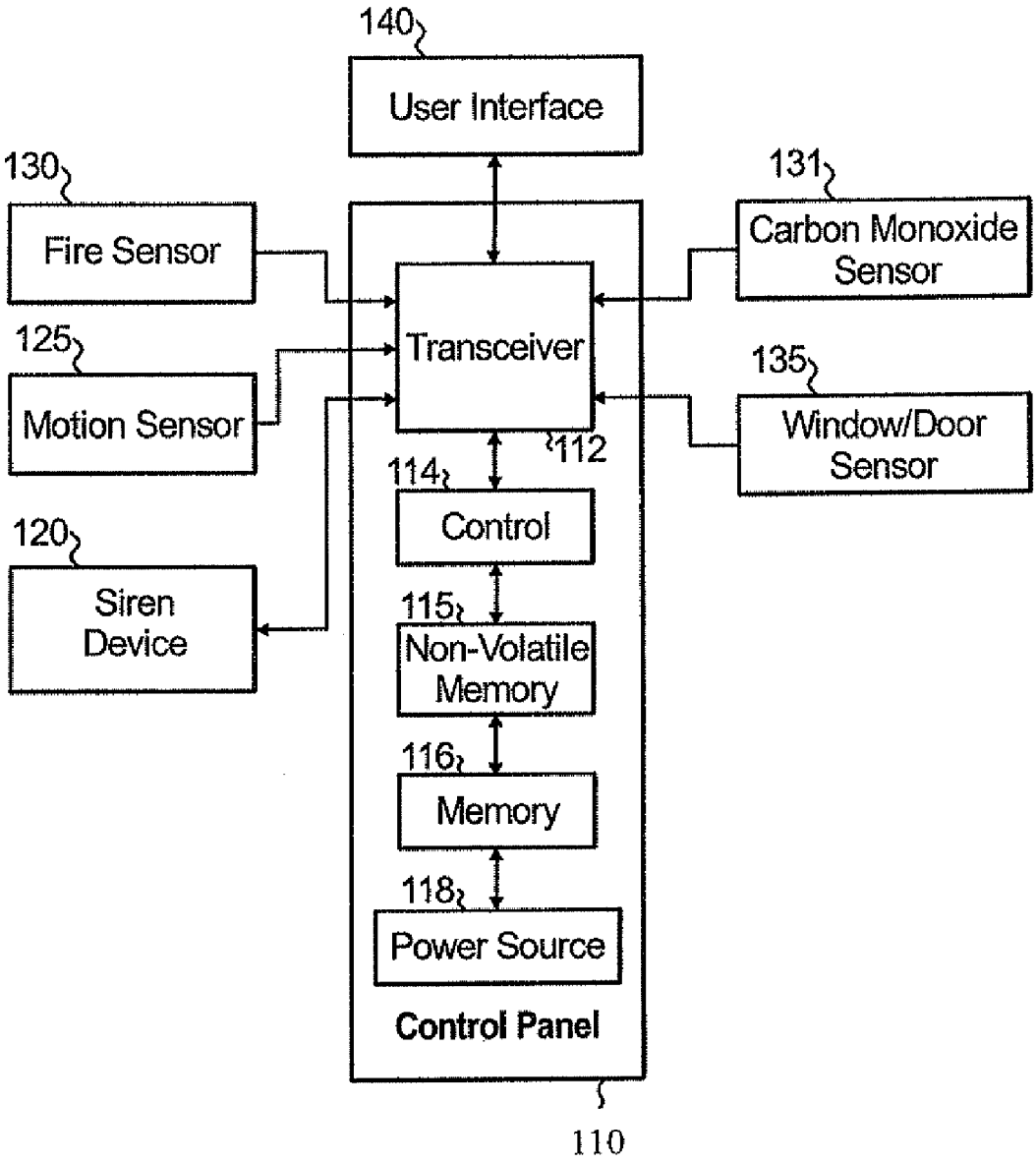
FIG. 1 illustrates a security device according to the invention.

FIG. 1 illustrates a local installed security system according to the invention. The security device 100 includes a control panel 110 that communicates with a number of sensors via a wired or wireless path. For example, the control panel 110 may receive signals from motion sensors 125 that can detect when a person enters a room. Signals received from fire sensors 130 indicate that a fire has been detected. Signals received from window and door sensors 135 indicate that a window or door has been opened. Signals received from the carbon monoxide sensor 131 indicate that carbon monoxide has been detected.

The control 114 includes a microprocessor that may execute software, firmware, and micro-code or the like to implement logic to control the security system 100. The control panel 110 may include a non-volatile memory 115 and other additional memory 116, as required. A memory resource used for storing software or other instructions that are executed by the control 114 to achieve the functionality described herein may be considered a program storage device. A dedicated chip such as an ASIC may also be used. A power source 118 provides power to the control panel 110 and typically includes a battery backup to AC power.

The control panel 110 can include a user interface device 140 integrated with the control panel 110 or a separate peripheral device can be connected to the control panel 110. The user interface device 140 is commonly provided in the home such as by affixing it to a wall or placing it on a table, for instance, while the control panel 110 generally is a larger component that may be installed, e.g., in a closet or basement.

Signals received from a peripheral user interface device 140, such as a keypad and display, a combined display and touch screen, and/or a voice interface may arm and disarm the system. The user interface device 140 is the primary interface between the user and the security system 100. When the user arms or disarms the system using the user interface device 140, a signal is transmitted from the user interface device 140 to the control panel 110.

The control panel 110 has the ability to notify a homeowner or business owner of an event such as an arming or disarming of the security system or a local emergency such as a fire or carbon monoxide detection or burglary.

Specifically, the control panel 110 includes a transceiver 112 for transmitting and receiving wireless signals.

In accordance with the invention, the control panel 110 can output predefined signal or cadence pattern to a notification appliance such as a siren device 120 via a wireless transceiver. Each cadence pattern will represent or correspond to a specific type of alarm event. For example, a cadence of steady-on is burglary, single-pulse is arm, two pulses with a pause is disarm, three pulses with a pulse indicates a fire has been detected and four pulses with a pause indicates a carbon monoxide detection. One or more of these cadence patterns is output as a single output from the control panel 110 to the siren device 120.

Based upon the cadence pattern, the siren device 120 will generate an audible voice signal that corresponds to the type of cadence. For example, if the siren 120 receives a signal containing four pulses with a pause, the siren 120 will generate an audible voice signal that indicates a detection of carbon monoxide such as "CARBON MONOXIDE".

Figure 2:
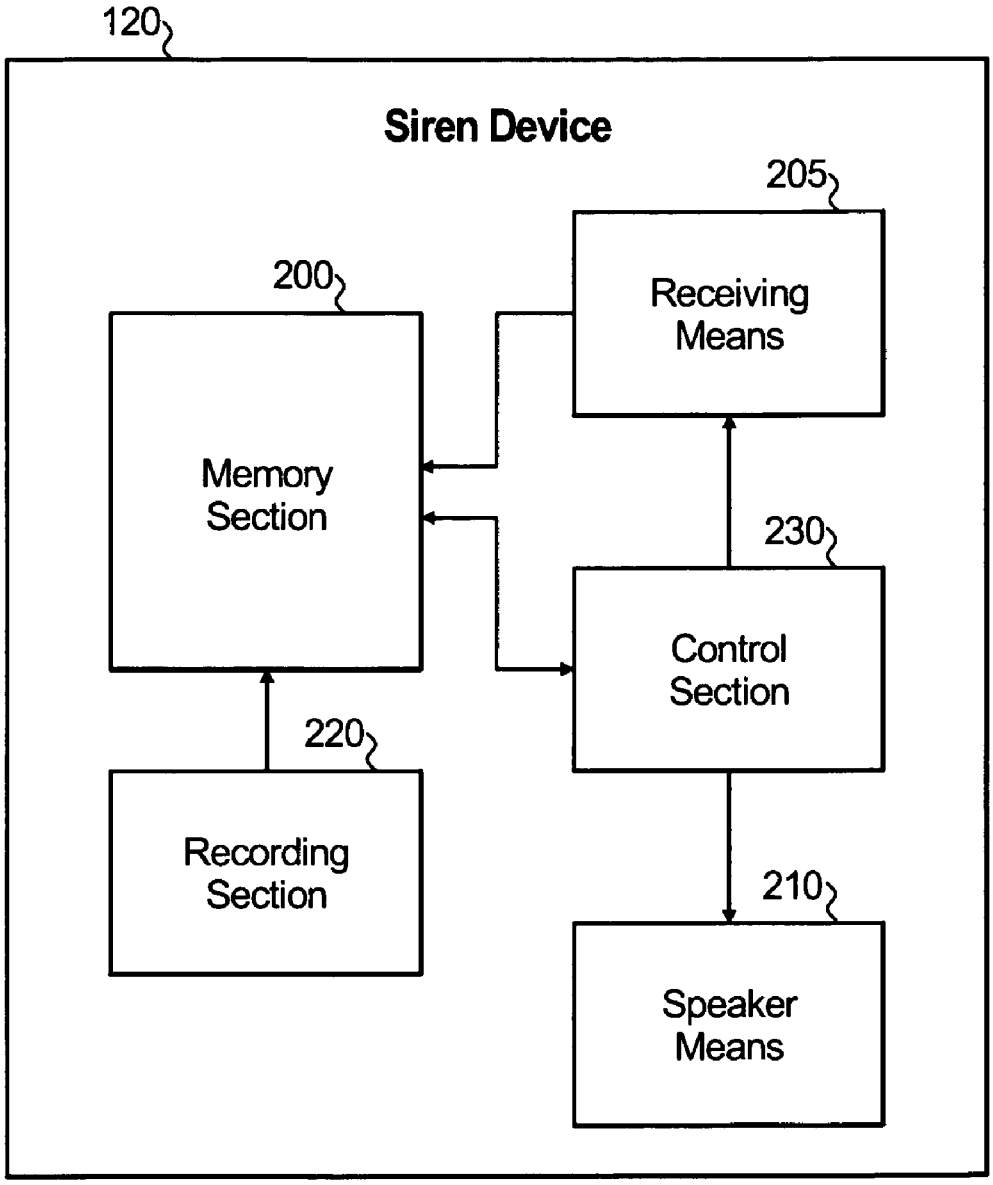
FIG. 2 illustrates a siren device according to the invention.

FIG. 2 illustrates the siren device used in the embodiment of the invention. The siren device 120 will include a memory section 200. a speaker means 210, an optional recording section 220, a control section 230 and a receiver means 205. The recording section 220 will allow a user to record a voice message in electronic data in any format including analog or digital. Preferably, the recording section 220 records the information in digital format. For example, the recording section 220 can be a digital microphone. Alternatively, the siren device 120 will include a pre-recorded default voice message or signal; one voice message for each type of alarm event. The pre-recorded message or recorded message will, be stored in the memory section 200.

The pre-recorded message or record message will be assigned and matched with each type of alarm event or alarm. For example, the recorded message for carbon monoxide will be assigned to the detection of carbon monoxide.

The siren device 120 can have any type of speaker means 210 that produce an audible sound. Suitable speakers include any audio reproduction device that can convert an electronic signal into sound including solid-state speakers, diaphragm speakers, or the like. A horn and siren type device can also be included to generate other audible sounds evidencing an emergency situation or alarm event.

Figure 3:
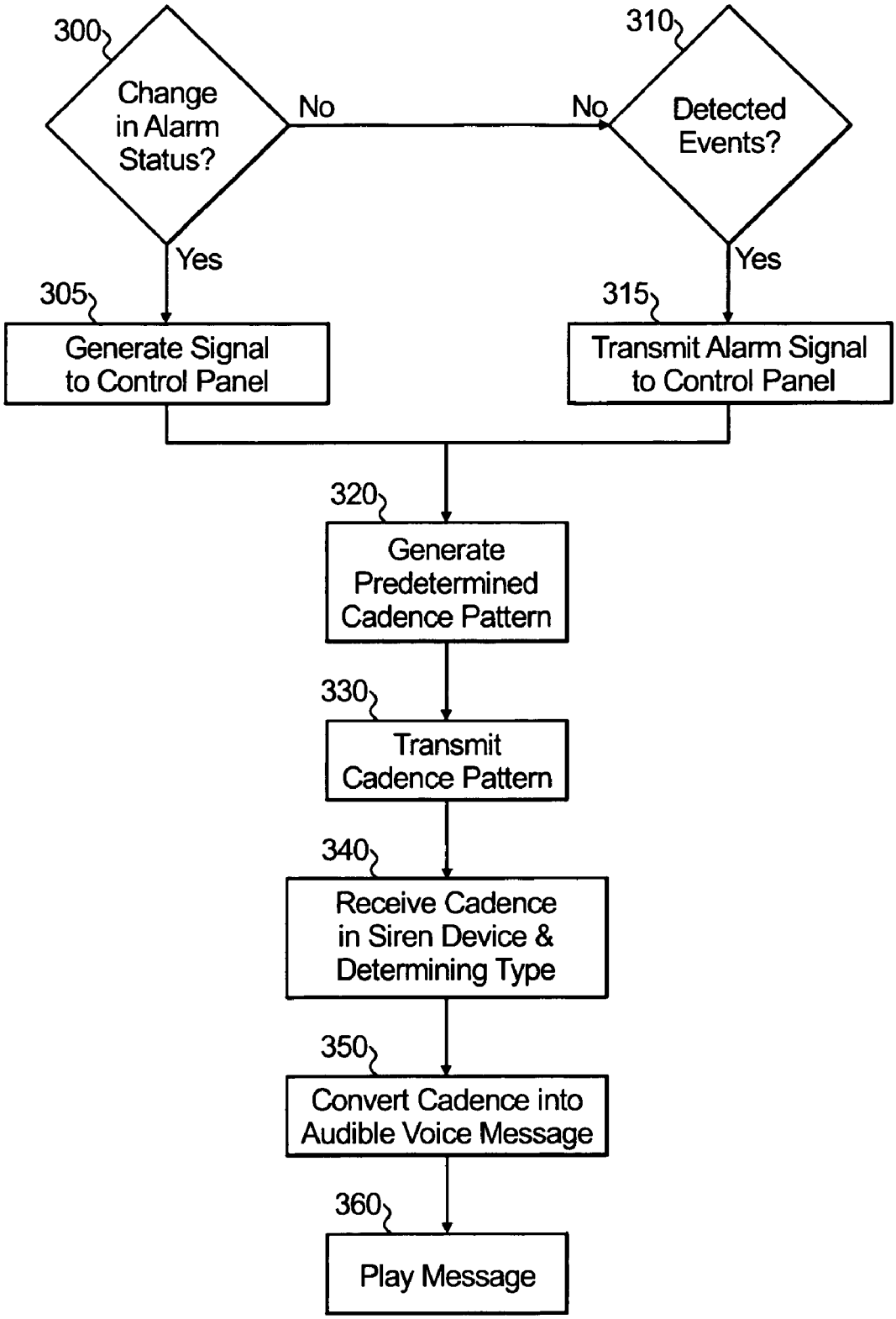
FIG. 3 depicts an illustrative embodiment of operating the security device according to the invention.

Referring now to FIG. 3, operation of the security device of the present invention will be shown and described in detail in view of the illustrated flow chart.

As shown in FIG. 1, the control panel 110 is in communication with a plurality of sensors 125, 130, 131, and 135 and a user interface means 140. Each one of the sensors or user interface means 140 is capable of generating an alarm event based upon a detected alarm event. The user interface means 140 will determine if the user has changed the status of the alarm system, at step 300. If the user has changed the status of the alarm system, the user interface means 140 will detect the change and generate a signal that corresponds to the change of status. This signal will be transmitted to the control panel 110 at step 305. There are two types of status signals, an arming signal that corresponds to an armed state for the security system, and a disarming signal that corresponds to a disarmed state for the security system. In the event of an alarm event, the corresponding sensor will generate a corresponding signal to notify the control panel of the event. If there is a detected event, sensors 125, 130, 131, and 135, at step 310, will transmit a signal corresponding to the detected event, respectively, to the control panel 110 via a wired cable or wireless transceiver 112 (step 315). For example, sensors 125, 130, 131, and 135 can generate a signal that corresponds to burglary, fire or carbon monoxide detection. FIG. 1 depicts a wireless transceiver 112, but any communication means can be used.

The control panel 110 will receive the signal regarding the detected alarm event or change in the system status from either sensors 125, 130, 131, and 135 and/or user interface means 140 and will store this information in the memory section 115 or 116. Simultaneously, the control panel 110 and, more specifically, the control section 114 will generate a predetermined cadence pattern or algorithm that corresponds to the received signal, at step 320.

The control panel 110, using its transceiver 112, will transmit the generated predetermined cadence pattern to the siren device 120, at step 330.

The receiving means 205 of the siren device 120 continuously monitor a transmission path between the control panel 110 and the siren device 120 to determine if a signal such as the predetermined cadence pattern is transmitted from the control panel 110 to the siren 120. The siren device 120 will determine if a signal has been transmitted from the control panel 110.

If a signal has been transmitted, the receiving means 230 in the siren device 120 will receive the signal and control section 230 will determine the type of predetermined cadence pattern. (step 340)

In an embodiment of the invention the determination step 340 includes counting a number of pulses received in one cycle of the cadence pattern. The cadence pattern is cyclical, repeating itself every predefined period (T). The control section 230 will count the number of pulses prior to a pause. The control section 230 will then compare the counted pulse number with a predefined count value stored in memory. Each unique pulse number or counted pulse corresponds with a specific alarm event or security system status. The predefined count value is pre-stored in the memory section 200.

Alternatively, the siren device 120 can include a pre-stored cadence pattern in the memory section 200 for one cycle of the cadence pattern. Upon receipt of one cycle of the cadence pattern; the control section 230 will compare the received cycle of the cadence pattern with the pre-stored pattern from the memory section 200 to determine the type of cadence pattern. Bach type of pre-stored cadence pattern corresponds to the predetermined cadence pattern. Depending on which pattern is received, the siren device 120 will output the corresponding audible signal.

Once the siren device 120 determines the type of cadence pattern, the control section will then convert the cadence pattern into an audible voice message, at step 350. The siren device 120 will match the cadence pattern with a corresponding pre-stored voice message, where the pre-stored message is stored in the memory section 200.

The pre-stored message is played on the speaker means 210 of the siren device 120, at step 360. The control section 130 will activate an amplifier attached to the speaker to enable an audible tone or message to be played, i.e., pre-stored message.

Figure 4A:
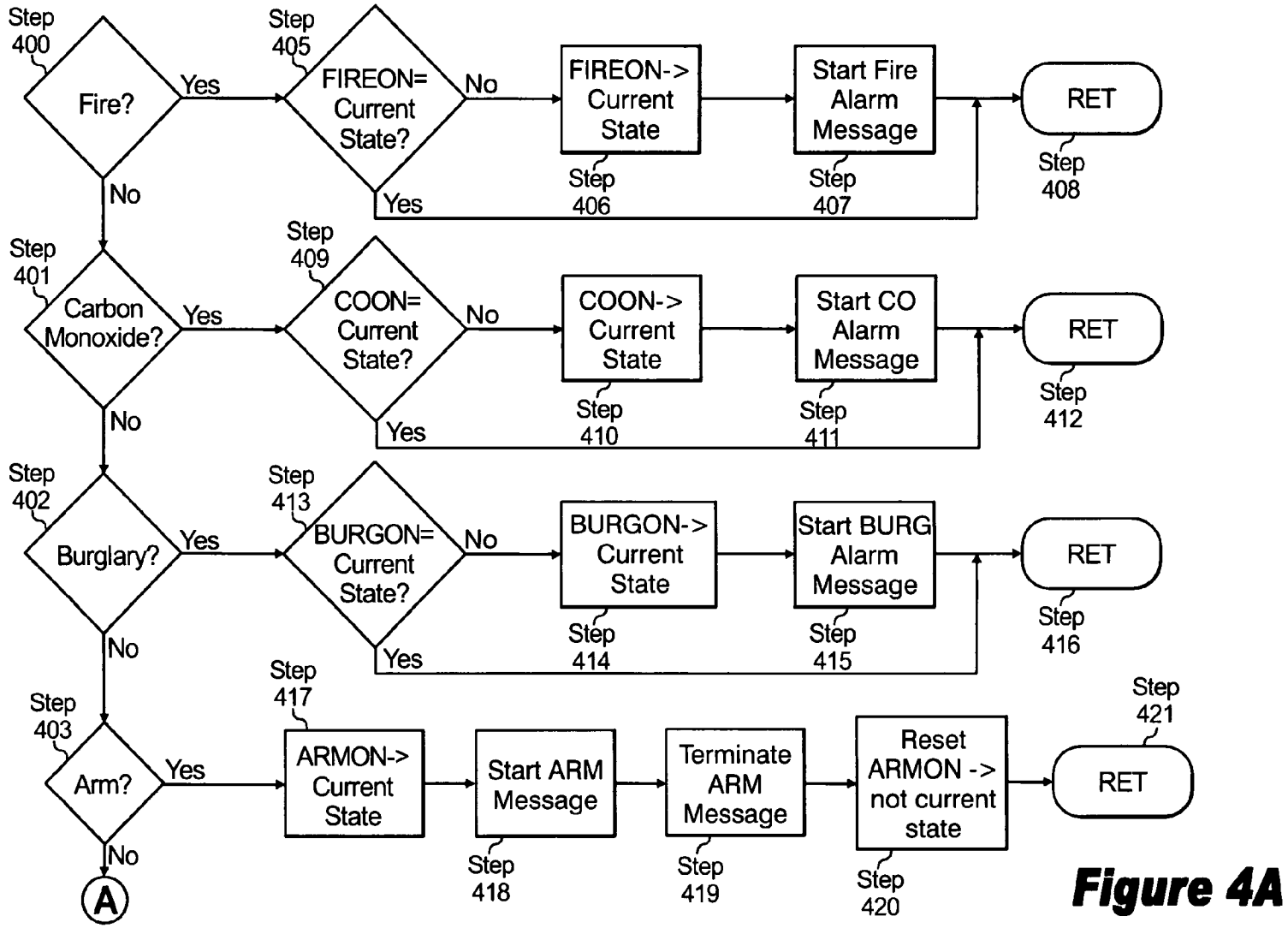
FIGS. 4A and B depict an illustrative embodiment of the method of generating a voice or tone message based upon a received cadence pattern according to the invention.
Figure 4B:
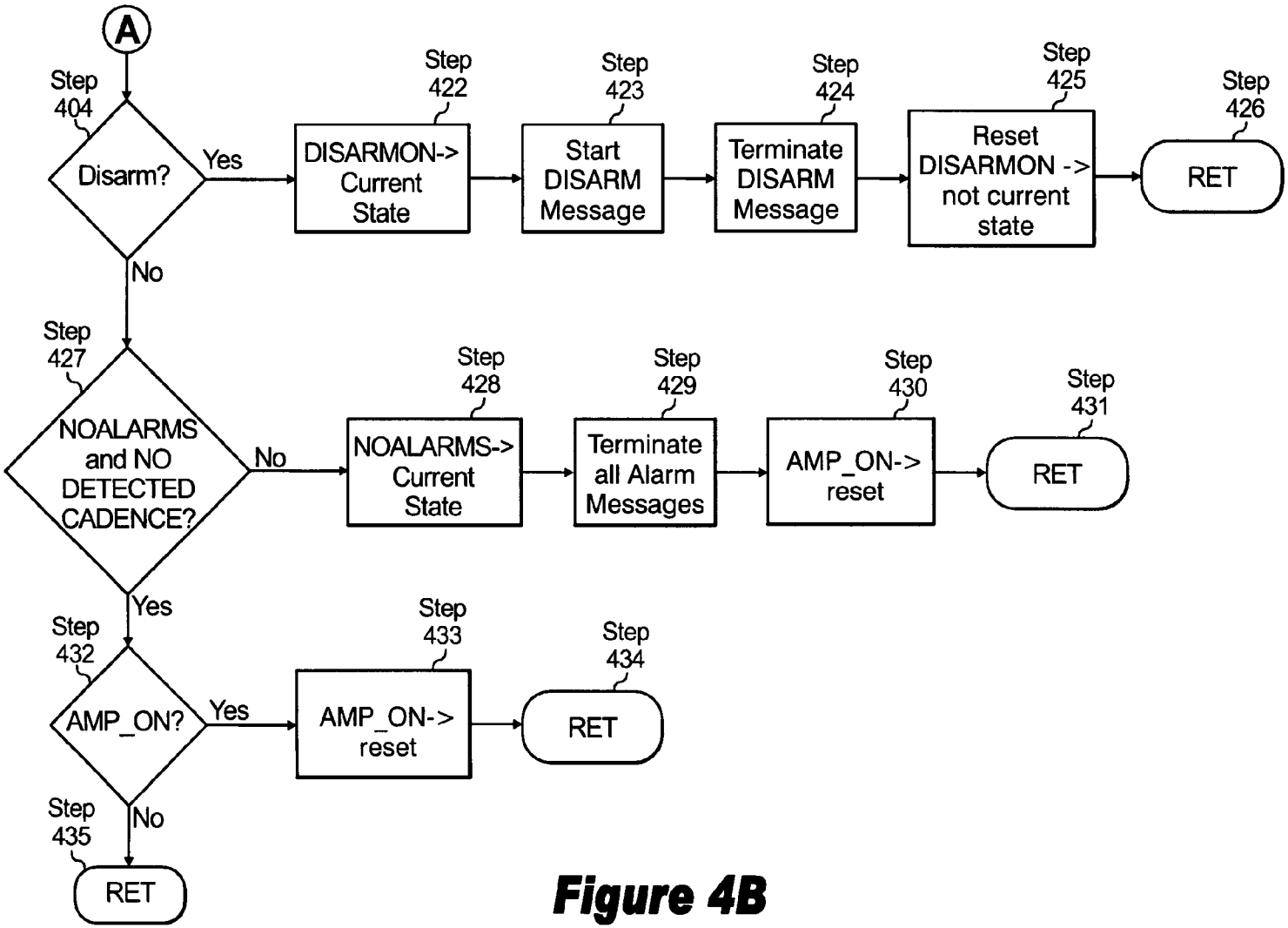

FIGS. 4A and 4B illustrate a flow chart of the steps for converting the determined cadence pattern into an audible voice or tone message. Based upon the determined cadence pattern the control section 230 will enter the converting process at different steps that correspond to the determined cadence pattern (Steps 400-404). The control section 230 will begin the process at step 400 if the determined cadence pattern indicates that the control panel has detected a fire. The control section 230 wilt begin the process at step 401, if the determined cadence pattern indicates that one or more sensors have detected carbon monoxide and reported the detection to the control panel. The control section 230 will begin the process at step 402, if the determined cadence pattern indicates that one or more sensors have detected a burglary or movement and reported the detection to the control panel. The control section 230 will begin the process at step 403, if the determined cadence pattern indicates that a user has armed the security system via a user interface in communication with the control panel. The control section 230 will begin the process at step 404, if the determined cadence pattern indicates that a user has disarmed the security system via a user interface in communication with the control panel.

If the process is at step 400, the control section 230 will determine if a flag FIREON that corresponds to a fire alarm is set, a step 405. If the flag is already set, indicating that a fire alarm message is already being played; the process goes to step 408. However, if the control section 230 determines that the flag is not set, i.e. current state, then the control section will set the FIREON flag to the current state, at step 406. This will cause the fire alarm to staff, at step 407, i.e. audible voice or tone message played.

If the process is at step 401, the control section 230 will determine if a flag COON that corresponds to a carbon monoxide alarm is set, at step 409. If the flag is already set, indicating that a carbon monoxide alarm message is already being played; the process goes to step 412. However, if the control section 230 determines that the flag is not set, i.e. current state, then the control section will set the COON flag to the current state, at step 410. This will cause the carbon monoxide alarm to start, at step 411, i.e. audible voice or tone message played.

If the process is at step 402, the control section 230 will determine if a flag BURGON that corresponds to a burglary alarm is set, a step 409. If the flag is already set, indicating that a burglary alarm message is already being played; the process goes to step 416. However, if the control section 230 determines that the flag is not set, i.e. current state, then the control section will set the BURGON flag to the current state, at step 414. This will cause the burglary alarm to start, at step 415, i.e. audible voice or tone message played.

If the process is at step 403, the control section 230 will set a flag ARMON to the current state at step 417. This will cause the arm message to start, at step 418, i.e. audible voice or tone message played. After a predetermined time period for playing the audible voice or tone message, the control section 230 will terminate the playing of the message, at step 419 and reset the flag ARMON, at step 420. For example, the message "ARMED" can be played twice for every time that the flag ARMON is set. There is no need to continuously play the armed message. After the flag is reset, the process proceeds to step 421.

If the process is at step 404, the control section 230 will set a flag DISARMON to the current state at step 422. This will cause the disarm message to start, at step 423, i.e. audible voice or tone message played. After a predetermined time period for playing the audible voice or tone message, the control section 230 will terminate the playing of the message, at step 424 and reset the flag DISARMON, at step 425. For example, the message "DISARMED" can be played twice for every time that the flag DISARMON is set. There is no need to continuously play the disarmed message. After the flag is reset, the process proceeds to step 426.

If no cadence pattern is received, the control section 230 proceeds to step 427. The control section 230 will then determine if a flag (NOALARMS) is set. If the flag is not set, the control section will set the NO ALARMS flag, at step 428, i.e. set NOALARMS to current state. The control section will terminate the playing of all audible voice or tone messages, at step 429. The control section 230 will also turn the power to the amplifier oft step 430. After resetting the AMP_ON flag, the process proceeds to step 431.

If the NOALARMS flag is already set, at step 427, the control section 230 will confirm that the power to the amplifier is off, at step 432. If the amplifier is on, i.e., AMP_On is set, the control section will terminate the power to the amplifier and reset the flag AMP_ON, at step 433. If the power to the amplifier is off, the process proceeds to step 435.

The siren device 120 continuously plays the audible voice or tone message for fire, carbon monoxide and burglary, i.e., pre-stored message as long as the device receives the corresponding cadence pattern.

Alternatively, in another embodiment, the pre-stored message can be repeated until the siren device 120 receives a reset signal.

Alternatively, in another embodiment, the pre-stored message can be repeated for a predetermined time period and then stopped and then repeated for another predetermined time period.

The invention has been described herein with reference to a particular exemplary embodiment. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A voice siren device comprising:

a receiving means for receiving at least one predetermined signal pattern from a security system control panel via a wireless transceiver, said at least one predetermined signal pattern corresponds to one of a plurality of detected events that has been detected by said control panel and said detection means, said plurality of detected events includes at least a detection of carbon monoxide;

a memory section for storing at least one cadence tone pattern and at least one pre-selected message that corresponds to said at least one cadence tone pattern;

a control section that compares said received at least one predetermined signal pattern with the stored at least one cadence tone pattern, and when a match is found, said control section selects said at least one pre-selected message that corresponds to said match for playback; and a speaker means for playing said at least one pre-selected message, wherein said at least one cadence tone pattern includes a pattern that corresponds to carbon monoxide.

2. The voice siren device of claim 1, further comprising a recording means for recording said at least one pre-selected message, and means for assigning said at least one preselected message to one of said at least one cadence tone pattern.

* * * * *